US006082745A

United States Patent [19]

Pellegrini, Jr. et al.

[11] Patent Number: 6,082,745

[45] **Date of Patent: *Jul. 4, 2000**

[54] REINFORCED SKATE

[75] Inventors: Alfred Pellegrini, Jr., Montebelluna; Alessandro Morandin, Villorba; Maurizio Tacchetto, Villa d'Asolo; Valerio Tonel, Biadene; Luca Vedoato, Cordenons, all of Italy

[73] Assignee: Benetton Sportsystem S.p.A., Trevignano, Italy

[ * ] Notice: This patent is subject to a terminal disclaimer.

[21] Appl. No.: 08/995,846

[22] Filed: Dec. 22, 1997

[30] Foreign Application Priority Data

Dec. 24, 1996 [IT] Italy ..... TV96A0167

[51] Int. Cl.[7] ..... A63C 17/06

[52] U.S. Cl. ..... 280/11.22; 36/115; 280/11.27

[58] Field of Search ..... 36/115, 88, 89; 280/11.19, 11.22, 11.23, 11.25, 11.27, 11.28, 809, 811

[56] References Cited

U.S. PATENT DOCUMENTS

| | | | |
|---|---|---|---|
| 922,774 | 5/1909 | Kennedy | 280/11.23 |
| 979,169 | 12/1910 | Kennedy | 280/11.23 |
| 5,380,020 | 1/1995 | Arney et al. | 280/11.22 |
| 5,588,228 | 12/1996 | Foscaro et al. | 36/89 X |
| 5,775,706 | 7/1998 | Caeran | 280/11.22 |
| 5,878,513 | 3/1999 | Annovi et al. | 36/115 |

FOREIGN PATENT DOCUMENTS

| | | | |
|---|---|---|---|
| 2 722 422 | 1/1996 | France . | |
| 12596 | 6/1896 | Switzerland | 280/11.23 |
| 1584 | 1/1893 | United Kingdom | 280/11.23 |

*Primary Examiner*—Michael Mar

*Attorney, Agent, or Firm*—Guido Modiano; Albert Josif; Daniel O'Byrne

[57] ABSTRACT

A reinforced skate including a frame for supporting wheels or an ice-skating blade, and associated with a shoe. The reinforcement includes a first rigid element and a second rigid element, which are articulated to each other and surround the quarter and the shell so as to laterally assume the shape of the Greek letter lambda. The first rigid element is connected, at its end, to the frame so as to form a structure which allows optimum transmission of forces to the frame.

20 Claims, 4 Drawing Sheets

REINFORCED SKATE

BACKGROUND OF THE INVENTION

The present invention relates to a reinforced skate, particularly an in-line roller skate or an ice skate; conventional skates are usually constituted by a supporting frame for wheels or for an ice-skating blade, above which a shoe is associated; said shoe is for example composed of a shell to which a quarter is articulated, or of a soft shoe which is optionally inserted in a rigid containment shell.

A problem which is felt in conventional skates is a difficulty in transmitting in an optimum manner the efforts of the foot and of the leg to the frame and therefore to the wheels or to the ice-skating blade.

For this purpose, this same Applicant filed an Italian Patent Application, No. MI94A001459, which relates to a skate with in-line wheels in which the shell is laterally connected to the wheel supporting frame by means of V-shaped brackets the free ends whereof are articulated at the pivots of the front and rear wheels.

Also this invention, however, does not solve the described problem, since transmission of applied forces is not optimum owing to the discontinuity between the frame and the shell, which are connected by interposed elements such as the brackets. Moreover, the brackets require preliminary assembly to the shell in a plurality of points and this increases the time required as well as production costs and possibly generates localized pressure regions which limit user comfort.

SUMMARY OF THE INVENTION

An aim of the present invention is to solve the described problems, eliminating the drawbacks of the cited prior art.

An object of the present invention is to provide a skate which allows to achieve optimum transmission of forces both from the leg and from the foot to the supporting frame of the wheels or of the ice-skating blade, so as to improve the technical steering and maneuverability characteristics of the implement.

A further object of the present invention is to provide a skate which allows to achieve greater containment and lateral strength and optimum reduction of vibrations on the frame, also eliminating lateral movements between the frame and the shell.

A further object of the present invention is to provide a device which has optimum comfort characteristics.

A further object of the present invention is to provide a skate which has low manufacturing costs, is structurally simple and can be manufactured with ordinary and conventional machines and equipment.

This aim, these objects and others which will become apparent hereinafter are achieved by a reinforced skate, comprising a frame for supporting wheels or a blade, and adapted to support a shoe having a shell, characterized in that it comprises at least one rigid element which is associated with the shell and has two first free ends which extend laterally from the malleolar region, respectively toward the tip and the heel of said shell, and are connected to said frame.

BRIEF DESCRIPTION OF THE DRAWINGS

Further characteristics and advantages of the present invention will become apparent from the following detailed description of some particular but not exclusive embodiments thereof, illustrated only by way of non-limitative example in the accompanying drawings, wherein.

DESCRIPTION OF THE PREFERRED EMBODIMENTS

Figure 1:
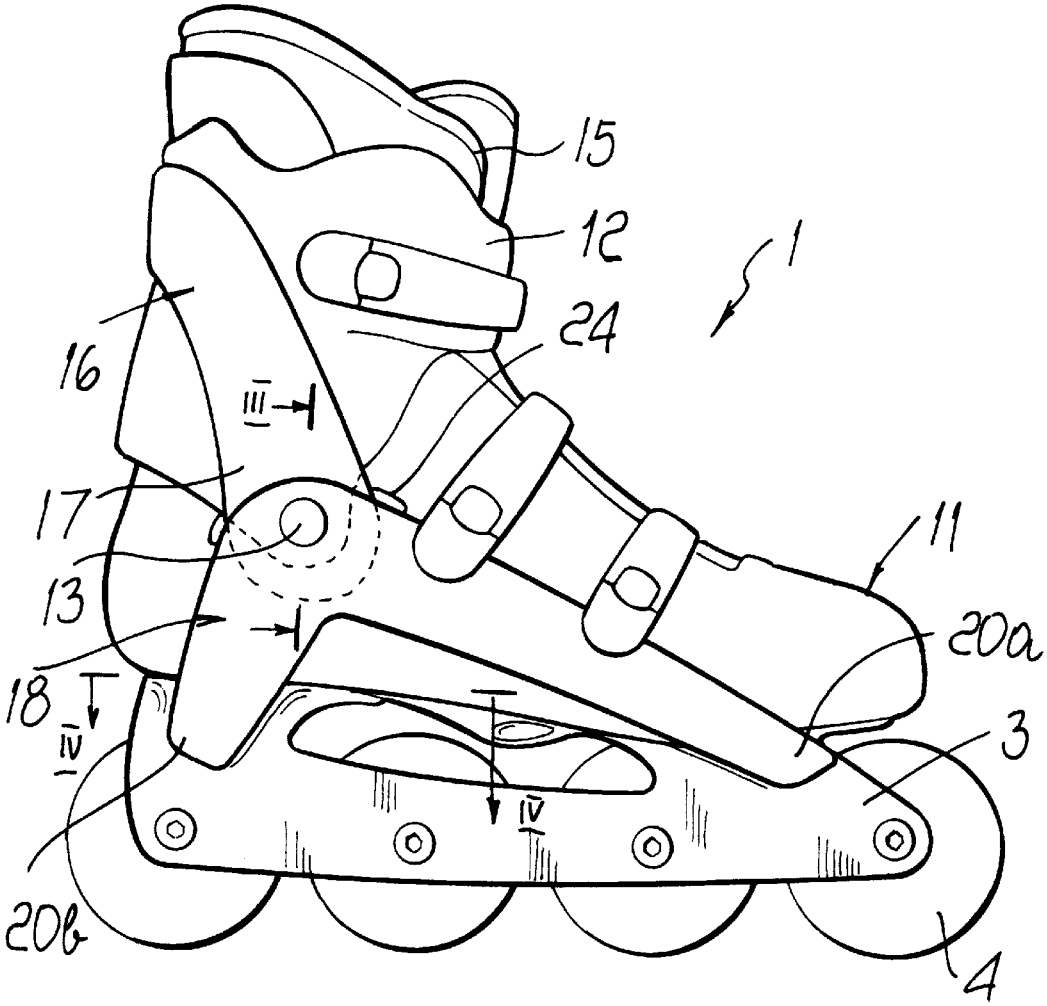
FIG. 1 is a side view of the reinforced skate.
Figure 3:
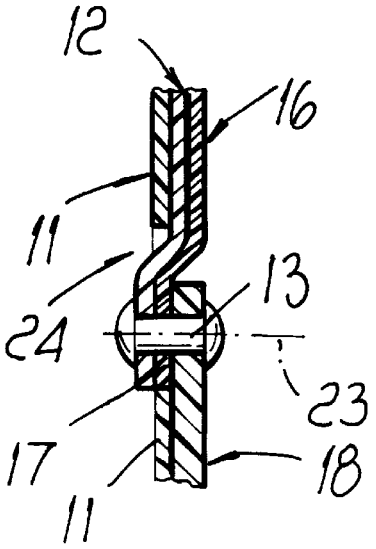
FIG. 3 is a sectional view, taken along the plane III—III of FIG. 1.
Figure 4:
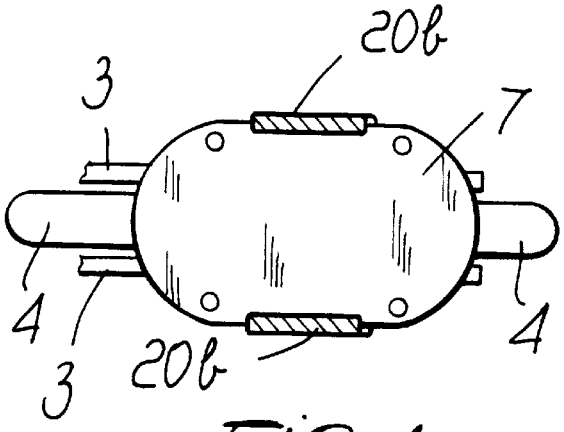
FIG. 4 is a sectional view, taken along the plane IV—IV of FIG. 1.
Figure 2:
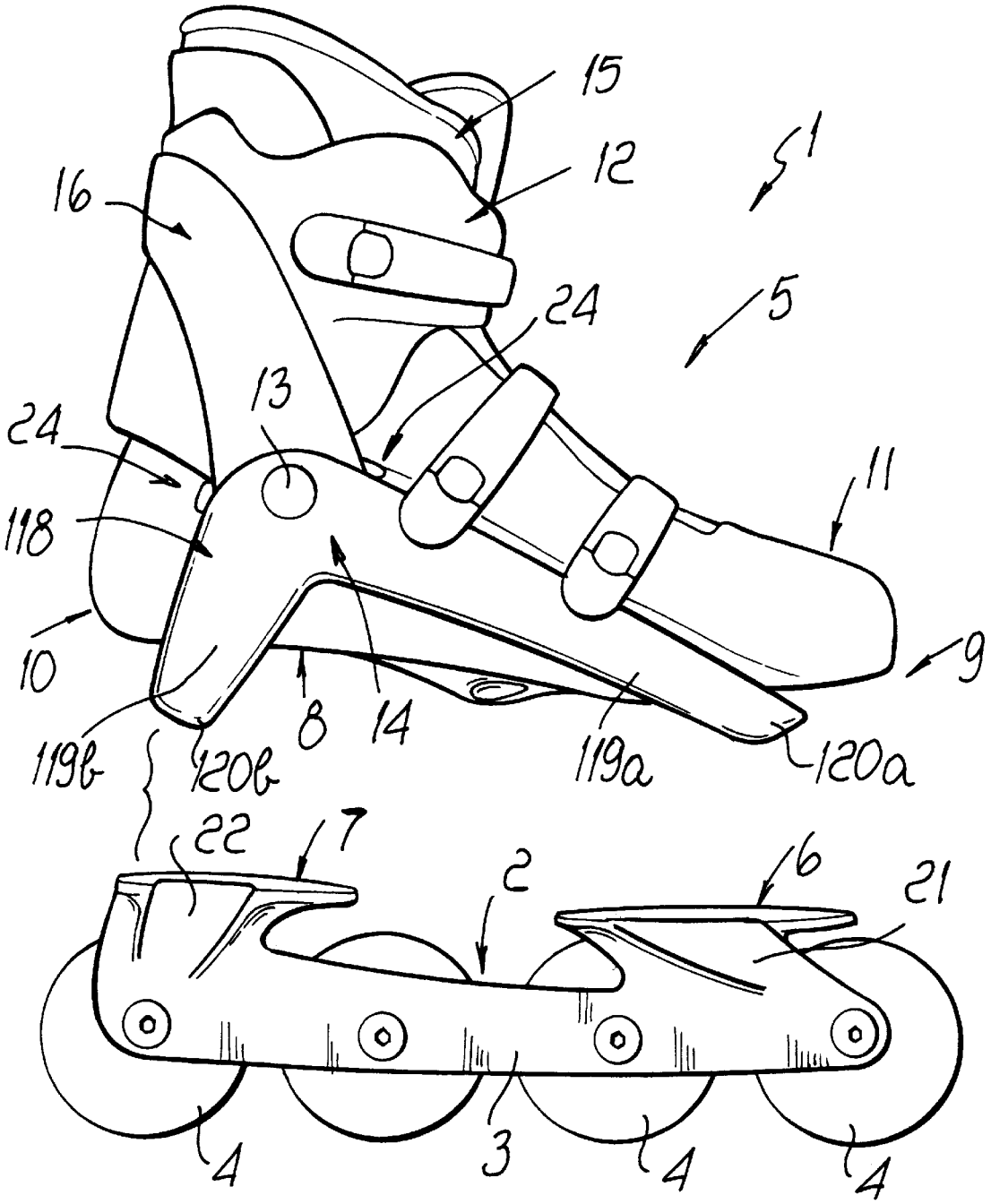
FIG. 2 is a view, similar to FIG. 1, of the frame disconnected from the remainder of the structure.

With reference to the above figures, the reference numeral 1 designates a skate, constituted by a frame 2, which has two mutually parallel lateral shoulders 3 between which suitable wheels 4 are pivoted or with which a suitable ice-skating blade (not shown) is associated.

The lateral shoulders 3 of the frame 2 are connected by at least one supporting base for the sole of a shoe 5; in the illustrated figure, the frame 2 has a first base 6 and a second base 7 for supporting, in the toe region 9 and in the heel region 10, the sole 8 of a shell 11 which constitutes said shoe.

The shoe comprises a quarter 12 which is articulated by means of suitable lateral studs 13 to the shell 11 in the malleolar region 14; a soft innerboot 15 is placed inside the shoe.

As an alternative, the shoe 5 can be constituted by a soft upper which surrounds the foot and the lower part of the leg.

The reinforcement for the skate 1 comprises a first rigid element 18, 118 which is constituted by a pair of brackets which are substantially L-shaped and are arranged laterally to the shell 11.

The reinforcement for the skate 1 also comprises a second rigid element 16, which surrounds the quarter 12 laterally and to the rear; said second element has second free ends 17 which affect the malleolar region 14.

Connection between the first rigid element 18, 118 and the second rigid element 16 allows rotation at the second free ends 17 of the second rigid element 16, in the region where the wings 19*a*, 119*a* and 19*b*, 119*b* of the pair of brackets join, preferably by means of the studs 13 for the mutual articulation of the shell and the quarter.

Connection between the first and second rigid elements provides, for said elements, a general structure which is shaped like the Greek letter lambda: the first free ends 20*a*, 20*b* of the first rigid element 18 extend beyond the sole 8 of the shell 11 and are connected to the frame 2.

Said lambda-shaped configuration of the first and second rigid elements substantially follows the directions along which the highest stresses are applied by the leg and by the foot by means of the quarter and the shell; said first and second rigid elements can be provided by mechanical connection, overmolding or similar technologies, or can be obtained by increasing the thicknesses of the quarter and of the shell in the respective regions so as to form in any case the same configuration.

Connection between the first free ends 20*a*, 20*b* and for example the first base and the second base 7 of the frame 2 can be obtained by means of conventional methods. For this purpose, as shown in the accompanying figures, it is possible to provide, in the regions located laterally to said first and second bases, suitable pairs of first seats 21 and second seats 22 for interlock coupling, the first free ends 20*a,* 20*b* being of course shaped complementarily thereto.

Figure 5:
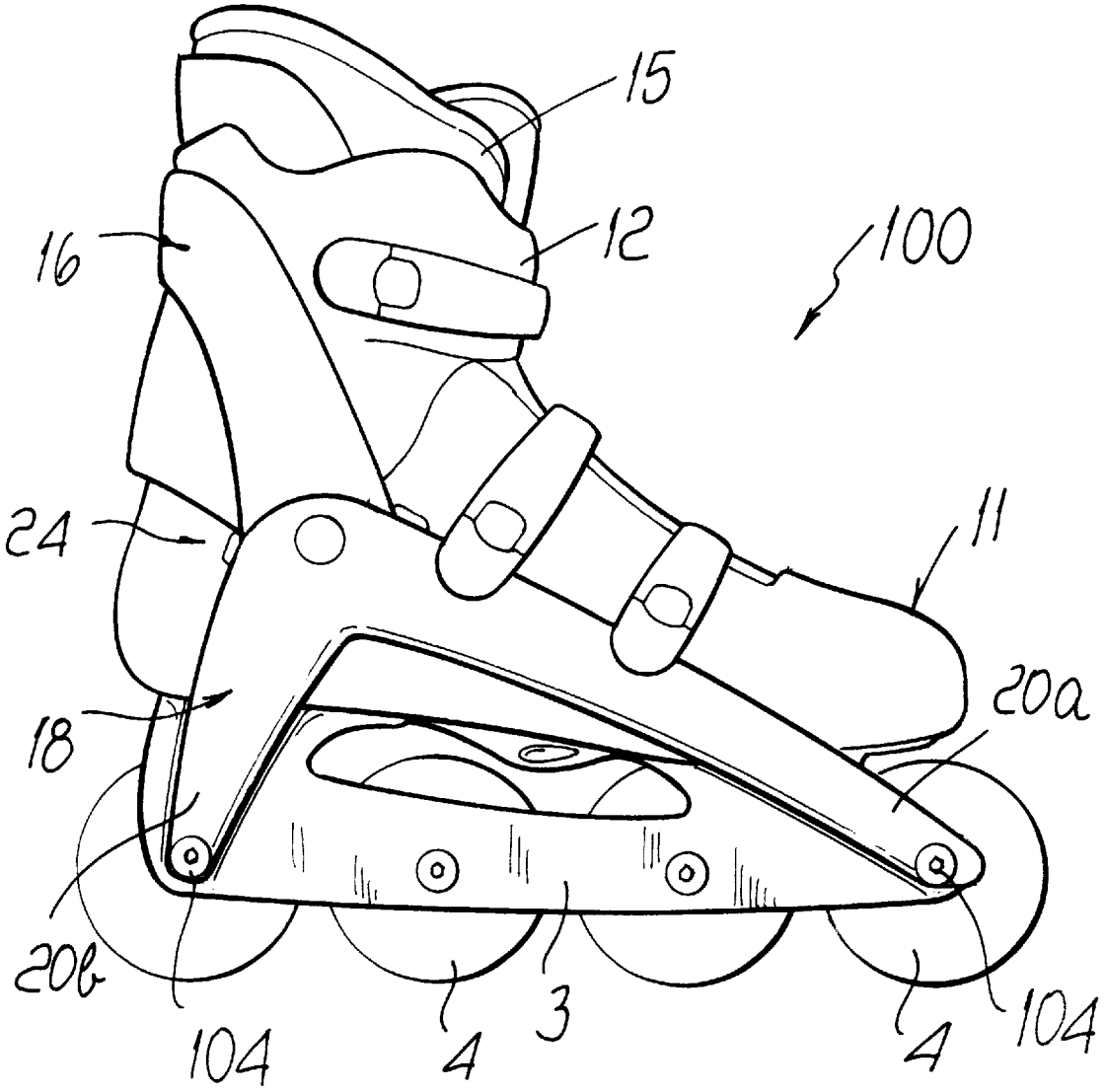
FIG. 5 is a view, similar to FIG. 1, of a second embodiment.

As an alternative, in skate 100, shown in FIG. 5, the first free ends 120*a,* 120*b* can be associated at the lateral shoulders 3 and at the frame 2 by means of fixing screws or at the pivots of the wheels 4.

An opening 24 is also formed at the shell 11, in the malleolar region 14, in a portion located above the articulation axis 23 of the studs 13; said opening is slotted and curved, with its concavity directed toward the underlying wheels 4, and this shape of the opening 24 allows the movement of the quarter 12, possibly inserted therein or located outside the shell, with respect to said shell 11; the second free ends 17 of the second rigid element 16 can be inserted at said opening.

The opening allows to produce tensions in the materials which increase the strength of the skate, particularly as regards lateral flexings produced during sports practice.

It is thus evident that the invention has achieved the intended aim and objects, a reinforcement for a skate having been obtained which allows optimum transmission to the frame of forces applied by the leg through the ankle and foot region, thanks to the particular configuration of the first and second rigid elements.

All the technical properties related to steering and maneuverability are thus improved, since the lambda-shaped configuration of the first and second rigid elements affects the directions along which the most intense forces are applied.

The reinforcement also allows better containment and lateral strength and a considerable reduction in frame vibrations and also eliminates any lateral movement of the frame with respect to the shell by means of the extension of the first free ends 20*a,* 20*b* and of the connection thereof to the frame.

Finally, improved comfort has been achieved since it is possible to use more comfortable material in contact with the foot, entrusting the rigidity of the components only to the first and second rigid elements.

Advantageously, a third rigid element can be interposed, transversely to said shell at the toe region, between the first ends 20*a* and 20*b* of the first rigid element 18.

Figure 6:
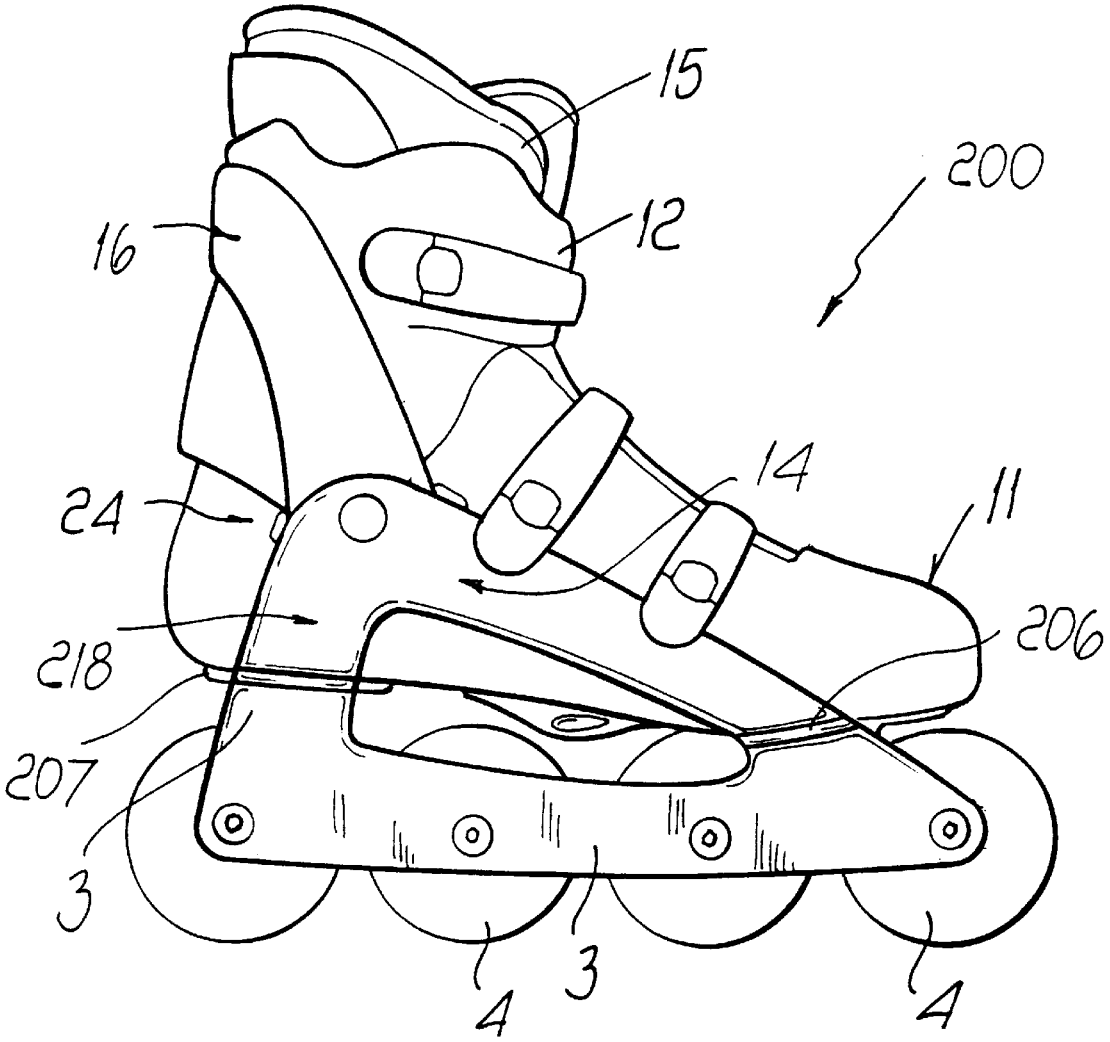
FIG. 6 is a side view of a reinforced skate according to a further aspect of the invention.

FIG. 6 shows a reinforced skate 200 according to a further aspect of the invention.

In this example the reinforced structure 218 is integral with frame 3 and is associated to the second rigid element 16 at the malleolar region 14 as in the above examples.

The frame and reinforced structure unit is provided with support members 206 and 207 for supporting the shoe shell 11.

Also the shoe shell 11 may be made integral with the frame and reinforced structure unit.

This embodiment further improves the technical properties of the skate, as described above, and also prevents the possibility of relative movements between the frame and the reinforced structure due to poor assembly of the components.

The materials and the dimensions that constitute the individual components of the reinforcement may of course be the most pertinent according to the specific requirements.

What is claimed is:

1. A reinforced skate comprising:

a frame for supporting wheels or a blade, said frame having a pair of lateral shoulders extending mutually parallel from a toe region to a heel region of the skate for supporting wheels or a blade between the pair of lateral shoulders;

a shoe having a sole, said shoe being a separate element from said frame, and said sole of said shoe being supported by said frame;

a pair of first rigid elements which are a pair of rigid lateral substantially L-shaped reinforcing elements connected with the shoe and overlapping the shoe at respective lateral sides of the shoe for reinforcing the shoe laterally and each one of said pair of rigid lateral substantially L-shaped reinforcing elements having two free ends which extend laterally of the shoe and downwardly from a malleolar region of the shoe, respectively toward the toe region and the heel region of the shoe, said pair of rigid lateral substantially L-shaped reinforcing elements being separate elements from said frame, and said two free ends of each of said pair of rigid lateral substantially L-shaped reinforcing elements being rigidly connected to said frame.

2. A reinforced skate according to claim 1, wherein each one of said pair of rigid lateral substantially L-shaped reinforcing elements comprises a substantially L-shaped bracket.

3. A reinforced skate according to claim 2, further comprising a second rigid element connected with the shoe and overlapping said shoe rearwardly and laterally of the shoe for reinforcing the shoe laterally and rearwardly, said second rigid element having a pair of free ends connected to the shoe at respective opposite malleolar regions of the shoe.

4. A reinforced skate according to claim 3, wherein each said L-shaped bracket and said second rigid element are connected such that a rotation connection is formed at the free ends of said second rigid element, in a region where wings of said two L-shaped brackets join.

5. A reinforced skate according to claim 3, wherein each said L-shaped bracket and said second rigid element are mutually connected so as to form an overall structure which is shaped like the Greek letter lambda, the free ends of each of said L-shaped bracket extending beyond said sole of said shoe and being connected to said frame.

6. A reinforced skate according to claim 4, wherein each said L-shaped bracket is connected to said second element by means of studs, said studs also connecting a shell to a quarter of said shoe.

7. A reinforced skate according to claim 3, wherein said shoes comprises a shell for accommodating a user's foot and a quarter pivotally connected to said shell, and wherein said pair of rigid lateral substantially L-shaped reinforcing elements are formed by increased thickness regions of said shell, and said second rigid element is formed by increased thickness regions of said quarter.

8. A reinforced skate according to claim 1, wherein pairs of first and second seats are formed on said frame in lateral regions of said frame for an interlock coupling of said free ends of each of said pair of rigid lateral substantially L-shaped reinforcing elements in said pairs of first and second seats.

9. A reinforced skate according to claim 1, wherein said free ends of each of said pair of rigid lateral substantially L-shaped reinforcing elements are connected at lateral shoulders of said frame at pivots of said wheels.

10. A reinforced skate according to claim 3, wherein said shoe comprises a shell for accommodating a user's foot and a quarter pivotally connected to said shell, and wherein an opening is formed in said shell in each malleolar region of the shell for the insertion of the free ends of said second rigid element.

11. A reinforced skate according to claim 10, wherein each said opening is provided at said shell, in the malleolar region and in a portion located above a mutual articulation axis of said quarter of said shoe and said shell, each said opening having a slotted and curved shape with a concavity directed toward the underlying wheels thereby allowing a movement of said quarter with respect to said shell, said free ends of said second rigid element being inserted at said opening.

12. A reinforced skate according to claim 1, wherein a third rigid element is arranged transversely to said shoe at the toe region and between front ends of said pair of rigid lateral substantially L-shaped reinforcing elements.

13. A reinforced skate comprising:

a frame for supporting wheels or a blade, said frame having a pair of lateral shoulders extending mutually parallel from a toe region to a heel region of the skate for supporting wheels or a blade between the pair of lateral shoulders;

a shoe having a sole, said sole of said shoe being supported by said frame;

a pair of first rigid elements which are a pair of rigid lateral substantially L-shaped reinforcing elements connected with the shoe and overlapping the shoe at respective lateral sides of the shoe for reinforcing the shoe laterally and each one of said pair of rigid lateral substantially L-shaped reinforcing elements having two free ends which extend laterally of the shoe and downwardly from a malleolar region of the shoe, respectively toward the toe region and the heel region of the shoe, said pair of rigid lateral substantially L-shaped reinforcing elements being separate elements from said frame, and said two free ends of each pair of rigid lateral substantially L-shaped reinforcing elements being rigidly connected to said frame.

14. A reinforced skate according to claim 13, further comprising a second rigid element connected with the shoe and overlapping said shoe rearwardly and laterally of the shoe for reinforcing the shoe laterally and rearwardly, said second rigid element having a pair of free ends connected to the shoe at respective opposite malleolar regions of the shoe.

15. A reinforced skate according to claim 14, wherein said shoe comprises a shell and a quarter pivoted to said shell, said pair of rigid lateral substantially L-shaped reinforcing elements being connected to said shell, and said second rigid element being connected to said quarter.

16. A reinforced skate according to claim 15, further comprising pivot elements for pivotally connecting said quarter to said shell and for pivotally connecting said second rigid element to said pair of rigid lateral substantially L-shaped reinforcing elements.

17. A reinforced skate according to claim 14, further comprising pivot elements for pivotally connecting said second rigid element to said pair of rigid lateral substantially L-shaped reinforcing elements, and wherein said shoe is constituted by a soft upper for surrounding a user's foot and lower leg.

18. A reinforced skate comprising:

a frame for supporting wheels or a blade, said frame having a pair of lateral shoulders extending mutually parallel from a toe region to a heel region of the skate for supporting wheels or a blade between the pair of lateral shoulders;

a shoe having a sole, said sole of said shoe being supported by said frame;

a rigid lateral substantially L-shaped reinforcing element connected with the shoe and overlapping the shoe at a lateral side of the shoe for reinforcing the shoe laterally and said rigid lateral substantially L-shaped reinforcing element having two free ends which extend laterally of the shoe and downwardly from a malleolar region of the shoe, respectively toward the toe region and the heel region of the shoe, said rigid lateral substantially L-shaped reinforcing element being a separate element from said frame, and said two free ends of said rigid lateral substantially L-shaped reinforcing element being in contact with said frame.

19. A reinforced skate according to claim 18, wherein a pair of seats are formed on said frame in a lateral region of said frame for an interlock coupling of said free ends of said rigid lateral substantially L-shaped reinforcing element in said pair of seats.

20. A reinforced skate according to claim 18, wherein said free ends of said rigid lateral substantially L-shaped reinforcing element is connected at a lateral shoulder of said frame at pivots of said wheels.

* * * * *